US005407203A

United States Patent [19]

Jones

[11] Patent Number: 5,407,203

[45] Date of Patent: Apr. 18, 1995

[54] GOLF CHIPPING GAME

[76] Inventor: William M. Jones, 10425 Medina Rd., Richmond, Va. 23235

[21] Appl. No.: 184,782

[22] Filed: Jan. 21, 1994

Related U.S. Application Data

[63] Continuation-in-part of Ser. No. 926,969, Aug. 7, 1992, abandoned.

[51] Int. Cl.[6] ..... A63B 57/00

[52] U.S. Cl. ..... 273/177 R; 273/123 R

[58] Field of Search ..... 273/176 F, 176 FA, 176 FB, 273/179 R, 180, 34 R, 123 R, 184 R, 177 R

[56] References Cited

U.S. PATENT DOCUMENTS

| | | | |
|---|---|---|---|
| 884,277 | 4/1908 | Hughes | 273/127 B X |
| 1,738,265 | 12/1929 | Scanlon | 273/178 R |
| 1,813,696 | 7/1931 | Crocker | 273/34 R |
| 3,342,495 | 9/1967 | Wasley | 273/127 R X |
| 3,876,210 | 4/1975 | Brandell | 273/180 |
| 3,891,213 | 6/1975 | Cooper et al. | 273/127 R X |
| 4,124,210 | 11/1978 | Mason | 273/177 R X |
| 4,429,882 | 2/1984 | Stanton | 273/177 R |
| 4,761,009 | 8/1988 | Gibree | 273/185 R X |
| 4,877,250 | 10/1989 | Centafanti | 273/176 F X |

*Primary Examiner*—William H. Grieb

[57] ABSTRACT

A golf chipping game including, a ball receiving target area with an entrance ramp leading to 5 or more ball receiving targets positioned around a curvature configuration wall. A player chips 5 balls from a position 10' to 20' forward of the target area attempting to get a ball in each of the target positions for a perfect score.

4 Claims, 2 Drawing Sheets

GOLF CHIPPING GAME

This is a continuation-in-part of application Ser. No. 07/926,969, filed Aug. 7, 1992, (Jones), abandoned.

BACKGROUND AND FIELD AND INVENTION

The present invention relates to Golf Games.

There are a number of golf games in the field of the present invention, the majority are putting games, in which a putter is used to putt a ball to a round hole or round ball receiving depression simulating a hole.

It is the primary object of the present invention to provide a novel golf chipping game, uniquely structured to put spin on a golf ball, and set up a variety of combination shots that will make the game interesting for the novice as well as the professional. A game that can be played and enjoyed by those who are physically or otherwise inaccessible to outdoor golf.

Accordingly, besides the primary objective of the applicant's invention, several other objectives and advantages are:

(a) To provide an intriguing indoor golf chipping game that requires a high degree of concentration, skill and strategy to become a proficient player.

(b) to provide a novel golf chipping game with a target area that will entrap an oncoming golf ball, that is chipped into the target area at a speed equivalent to the speed needed to chip a golf ball into a regulation size golf hole on an outdoor golf course.

(c) to provide an indoor golf game so challenging as to preoccupy the player and give the same therapeutic effect as playing an outdoor round of golf.

(d) to provide a portable golf chipping game, small and light enough to be carried in an attache case or overnight travel bag, whereby one would have it available for use whether in an office, motel, pro-shop, or other suitable confined area.

(e) to provide an interesting, simple, and durable golf chipping game apparatus that can be manufactured economically for sale to the general public.

(f) to provide a golf chipping game that can be played by one person or can be played competitively by two or more players.

(g) to provide a golf chipping game and practice apparatus that rewards a player for imparting spin to a golf ball with a chipping club, when playing the game.

(h) to provide a novel golf chipping game with five or more scoring positions so located that when balls occupy the scoring positions they would be in a position to drop into a regulation size golf hole.

(i) to provide a precision indoor golf chipping game, that will appeal to the perfectionist characteristics of core golfers. A game that requires a ball to be chipped with near perfect speed and direction. A game that will deflect a ball that is chipped to the target area at a high rate of speed. A game that will reject a ball that is hit to the target area in the wrong direction. A game that is however fair and will intercept and entrap a ball that is played to the target area with proper speed and direction.

Figure 1:
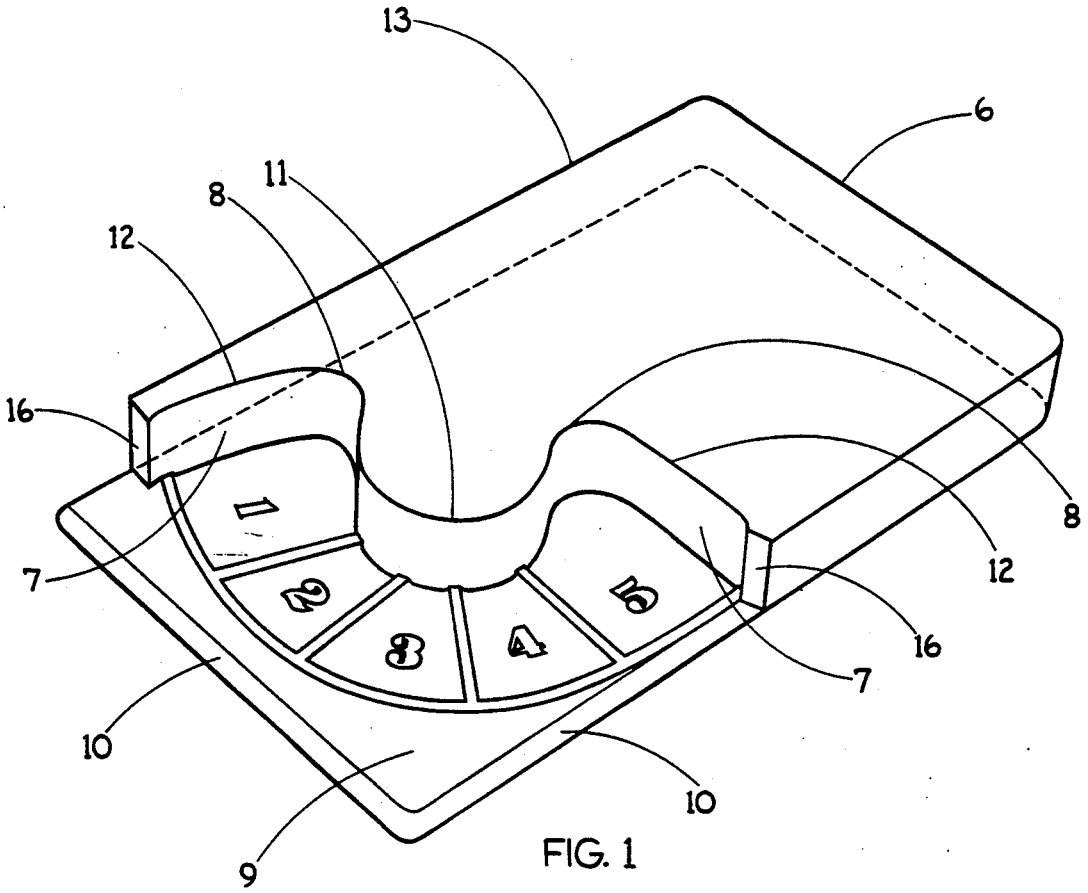
FIG. 1 is a perspective view of the golf chipping game apparatus comprising the present invention.

| Reference Numerals in Drawings | |
|---|---|
| 1–5. Ball receiving depressions | 11. Semi Circle Radius |
| 6. Base Member | 12. Major Concave Radii |
| 7. Curvature Configurated Wall | 13. Golf Chipping Game |
| 8. Minor Concave Radii | 14. Target Area Felt Cover |
| 9. Level Plane | 15. Rail Means |
| 10. Entrance Ramps | 16. Deflection Blocks |
| 17. Countersunken area | 18. Embossed Lines |

DESCRIPTION OF PREFERRED EMBODIMENT

With reference to the drawings, and in particular FIG. 1 thereof, a new and improved golf chipping game embodying the principles and concepts of the present invention and generally designated by the reference numeral 13 will be described. More specifically, it will be noted that a golf chipping game 13, essentially comprises a base member 6 comprising a near end for containing a target area essentially comprising entrance ramps 10 leading from a supporting surface to a level plane 9, which connects the entrance ramps to a plurality of ball receiving depressions numbered 1,2,3,4 and 5. The ball receiving depressions being contiguous to a curvature configuration entrapment wall 7, comprising a semi circle 11, connected to major concave Radii 12, by means of minor radii 8, being tangent with said major radii 12, and semi circle 11. Concave radii 12, extend to points near each side of base member 6, and straight lines extend therefrom to the edges of the base member at slight angles away from the near end of the base member, forming deflection blocks 16, to deflect oncoming balls that are off line.

Figure 2:
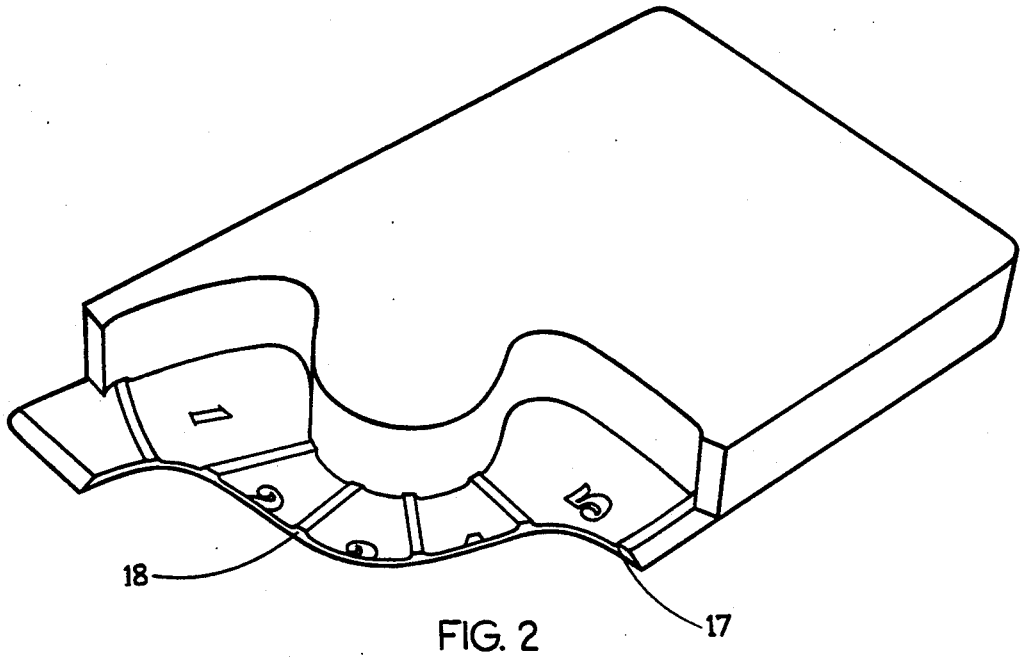
FIG. 2 is a sectional view of the ball receiving depressions
Figure 3:
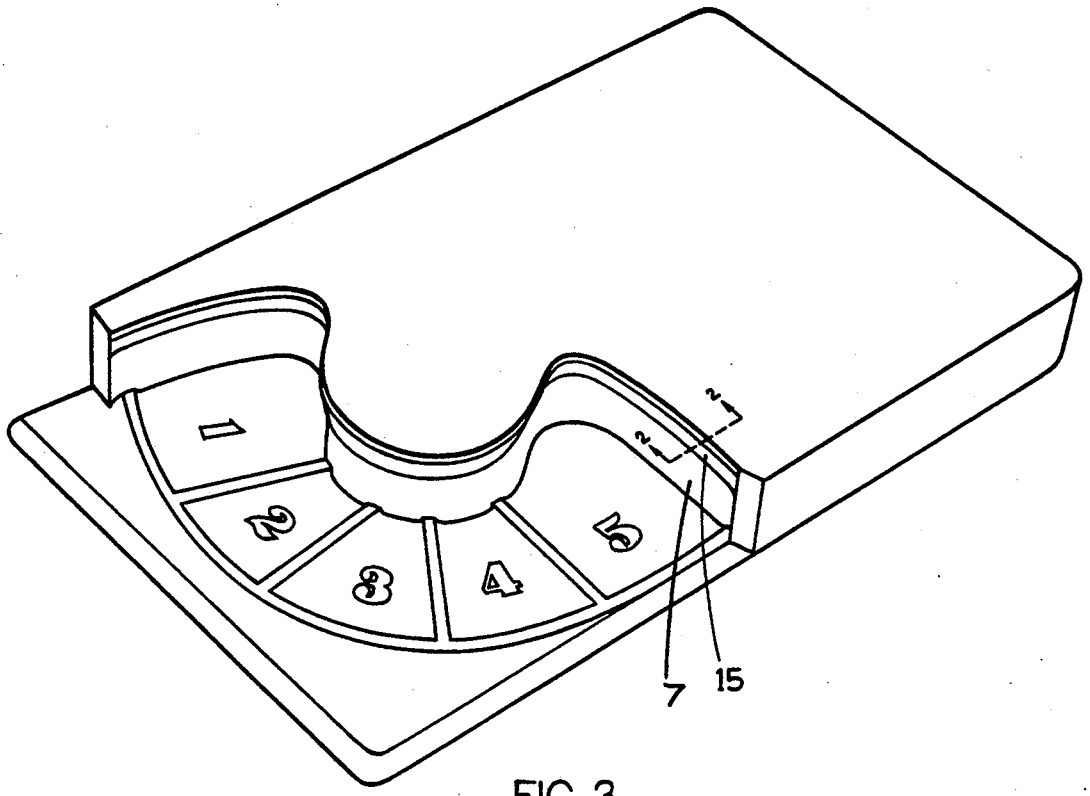
FIG. 3 is a perspective view showing the rail means
Figure 4:
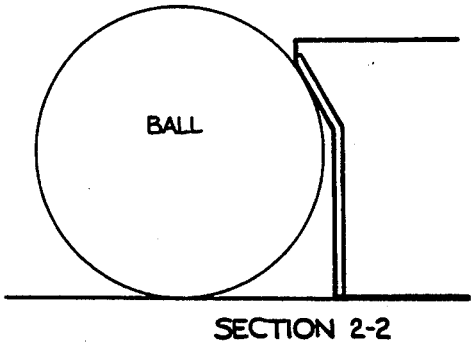
FIG. 4 is a sectional view of the rail detail

The ball receiving depressions are countersunken approximately 3/32", 17, FIG. 2 and the lines between each ball receiving depression are embossed approximately 3/64", 18, FIG. 2, whereby a ball will not come to rest directly on a line, yet the embossed lines are not high enough to prevent a ball from spinning around the curvature configuration entrapment wall 7. A preferred material for the base member is a fine hardwood or tough resilient plastic, or combination thereof.

As to the manner of usage and operation of the present invention, a game is played with a chipping club and five more or less golf balls depending on the number of scoring positions in a particular game. A player stands forward of the target area and attempts to chip a ball into each of the ball receiving depressions to obtain a perfect score. The ball receiving depressions are designated as scoring positions and numbered according to the degree of difficulty for a player to chip a ball into the corresponding position. The numbers in the scoring positions where balls finally come to rest during a game are totaled to determine a player's score.

The golf chipping game 13, FIG. 1 is considered a right hand model, and rewards a player for imparting counter clockwise spin to a ball when playing to the target area. A ball with counter clockwise spin can enter the scoring area at a faster rate of speed and remain in the target area. A ball with counter clockwise spin when entering the target area will have a tendency to spin from left to right around the curvature configuration wall from a lower to a higher scoring position. A player may play a combination shot thereby hitting a stationery ball with an oncoming ball, and spinning the stationery ball around the curvature configuration entrapment wall to a more favorable position.

An angular rail 15, extends along the upper portion of the curvature configuration entrapment wall 7, forming a wedge shape between an essentially level plane of the plurality of ball receiving depressions, and the angular rail 15. A ball entering the target area will wedge between the angular rail and the plane of the ball receiving depressions, before coming in contact with the curvature configuration entrapment wall 7.

What is claimed as being new and desired to be protected by Letters Patent of the U.S. is as follows:

1. A golf chipping game comprising, a ball receiving target area, positioned forward in a base member, including forward and side entrance ramps 10, leading to a level plane 9, contiguous to less than seven ball receiving depressions, said ball receiving depressions are contiguous and concentric to a semi circle radius 11, having a diametrical dimension less than a diameter of a regulation size golf hole, whereby said ball receiving depressions receive golf balls entering said target area and provide a positive score.

2. A golf chipping game comprising, a curvature configuration entrapment wall 7, positioned forward in a base member 6, including a semi circle radius 11, turned convexly from a plurality of ball receiving depressions and connected by minor concave radii 8, to major concave radii 12, thereby, forming said curvature configuration entrapment wall 7, for intercepting and entrapping oncoming golf balls.

3. A golf chipping game as defined in claim 2, comprising, a curvature configuration entrapment wall extending to points near each side of base member 6, and from said points at slight angles away from the forward end of said base member, straight planes extend to the outer edges of said base member, forming deflection blocks 16, whereby said deflection blocks deflect golf balls approaching off line from the ball receiving target area.

4. A golf chipping game as defined in claim 2, comprising, an angular rail 15, extending along the upper portion of a curvature configuration entrapment wall 7, forming a wedge shape between an essentially level plane of a plurality of ball receiving depressions and said angular rail 15, whereby, a ball entering the target area will wedge between said angular rail and the level plane of said plurality of ball receiving depressions, before coming in contact with said curvature configuration entrapment wall 7.

* * * * *